US005305628A

United States Patent [19]

Cluggish

[11] Patent Number: 5,305,628

[45] Date of Patent: Apr. 26, 1994

[54] RING FASTENER PACKAGE FOR MOVABLE MAGAZINE OF A PORTABLE TOOL

[75] Inventor: Raymond F. Cluggish, Indianapolis, Ind.

[73] Assignee: Stanley-Bostitch, Inc., East Greenwich, R.I.

[21] Appl. No.: 978,399

[22] Filed: Nov. 18, 1992

[51] Int. Cl.[5] ..... B21D 39/00; B21F 45/16

[52] U.S. Cl. ..... 72/410; 29/243.56; 24/30.5 W; 206/340

[58] Field of Search ..... 72/410, 409, 424; 29/243.56, 816; 24/30.5 W, 20 CW, 27, 115 A; 206/338-340

[56] References Cited

U.S. PATENT DOCUMENTS

| | | | |
|---|---|---|---|
| 2,728,965 | 1/1956 | Hillman | 24/115 A |
| 2,927,324 | 3/1960 | Ollig | 206/340 |
| 3,064,263 | 11/1962 | Powers | 72/410 |
| 3,120,230 | 2/1964 | Skold | 24/30.5 W |
| 5,035,040 | 7/1991 | Kerrigan | 72/410 |

*Primary Examiner*—Daniel C. Crane

*Attorney, Agent, or Firm*—Cushman, Darby & Cushman

[57] ABSTRACT

A package of ring fasteners comprising a multiplicity of similar ring fasteners each being made of a short length of metal wire of no smaller than 0.101 inch diameter material bent to provide a central bight portion and leading and trailing legs extending from opposite ends of said central bight portion terminating in spaced free ends. Each ring fastener is shaped so that the free ends of the leading and trailing legs are disposed substantially on opposite sides of a plane perpendicular to the direction of extent of a row of such ring fasteners releasably retained together so as to be handled and inserted as a unit into a tool magazine capable of being moved transversely from (1) a cooperating position with respect to a pair of movable tool jaws into (2) a spaced non-interfering position during which the remaining ring fasteners are separated from the leading ring fastener in interfaced relation with the pair of jaws enabling the pair of jaws to be moved toward one another to crimp the interfaced leading ring fastener into a closed ring configuration.

18 Claims, 5 Drawing Sheets

Fig. 10.
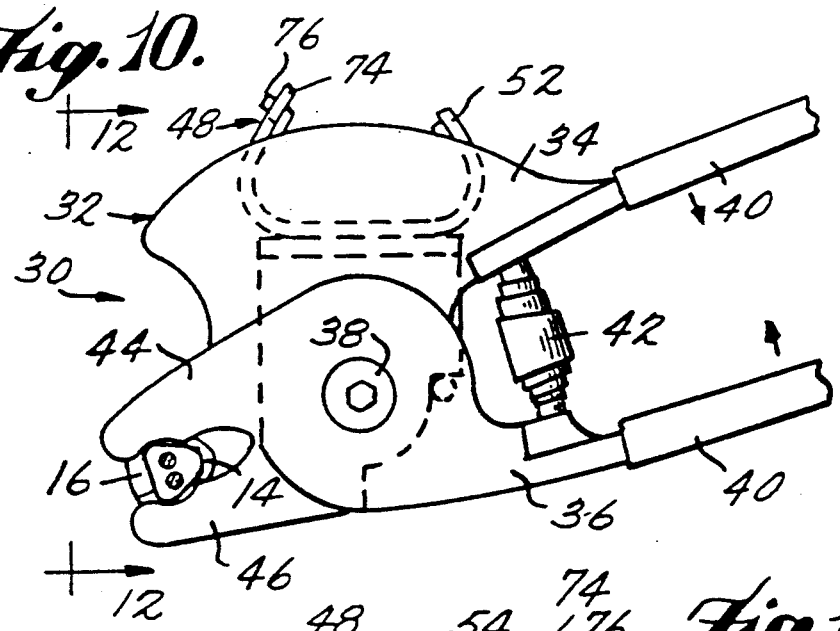
Fig. 11.
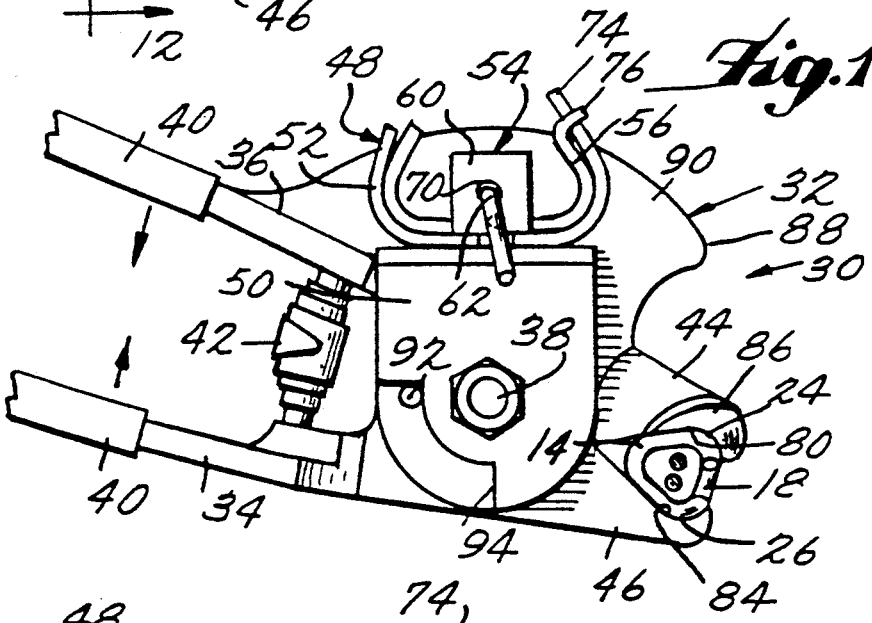
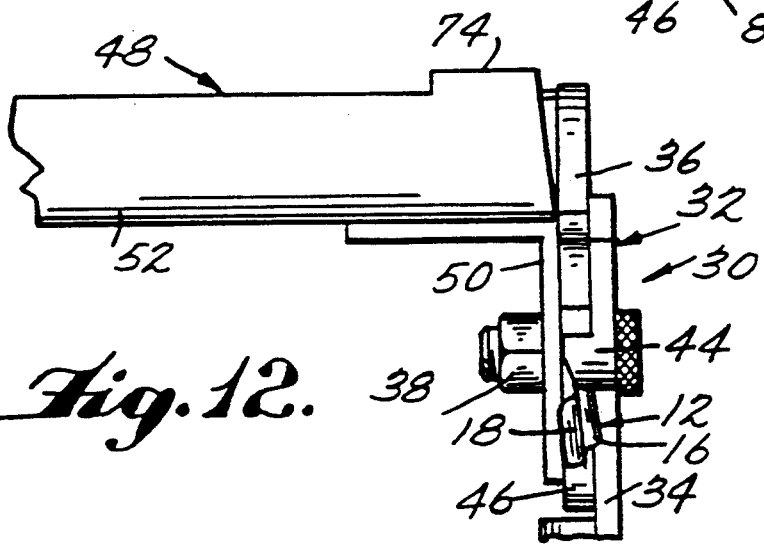
Fig. 12.

RING FASTENER PACKAGE FOR MOVABLE MAGAZINE OF A PORTABLE TOOL

This invention relates to ring fasteners and, moret particularly, to ring fastener packages and a portable tool having a magazine capable of handling such ring fastener packages.

The type of ring fastener herein contemplated is specifically the type which is used in accordance with Federal Highway Specifications—Fencing 909.18, paragraph C, table 1, in installing chain link fence to secure the lower edge of the chain link fencing to the cable or wire which extends between the fence posts. The purpose of securing the fencing along its lower edge to the cable is to prevent the lower portion of the chain link fencing from being readily displaced horizontally.

In order to provide adequate securement between the fencing and the cable, ring fasteners are currently being used which are either made of 9 gauge wire when the wire is made of aluminum alloy or of 12 gauge wire when the wire is made of steel alloy. The ring fasteners are generally of U-shaped configuration similar to staples except the legs are bent in more toward one another rather than being at right angles.

The current practice is for the supply of ring fasteners to be packaged in bulk containers. Each fence worker is provided with a pouch for containing a bulk batch of individual ring fasteners and a pliers-like hand tool into which individual ring fasteners can be manually interfaced for subsequent manual clinching by the tool once the ring fastener interfaced with the tool is moved into a position suitable to receive the cable and chain link therein between the legs of the ring-shaped fastener. Thereafter, the crimping of the ring fastener results in the crown or bight portion of the ring fastener bending at its middle bringing the legs generally into side-by-side relation so that the ring fastener assumes a final delta shape. It is characteristic of this type of ring fastener that in its bulk packaged condition each is preformed so that the legs are not only bent from the crown beyond 90° but they are also bent out of the plane of the crown in opposite directions so that during the crimping action the ends of the legs do not substantially interfere with one another enabling the legs to readily assume a final side-by-side posture. Indeed, it is often the case that the ends of the legs are bluntly cut off sometimes at a blunt angle which extends in directions opposed to directions which would tend to cam the legs into their final postures if interengaged.

It can be appreciated that considerable time is taken up in a typical work day in undertaking the steps necessary in the use of the ring fastener which includes (1) removing an individual ring fastener from the pouch, (2) interfacing the individual ring fastener with the jaws of the plier-like hand tool, (3) manually gripping the ring fastener in the jaws of the plier-like tool, (4) bringing the ring fastener into operative relation to the cable near the ground and a lower link of the fencing so that the two elements extend between the legs of the ring fastener adjacent the crown, and finally (5) crimping the ring fastener by manually squeezing the tool handles so that the cable and fence link will be held together within the delta shape of the crimped ring fastener.

When it is further considered that it is usual for such workmen to wear gloves, particularly if the weather is cold, it is not unusual for a number of ring fasteners to be dropped on the ground and abandoned before each ring fastener can be properly interfaced, deployed, and crimped during a day's work.

It is an object of the present invention to overcome the problems of inefficient operating time and ring fastener lossage which exists with current practices. In accordance with the principles of the present invention, this objective is achieved by first providing the ring fasteners in a packaged form in which they can be interfaced collectively with the tool and second by providing a manually actuated portable tool having a magazine for containing and handling the ring fasteners in packaged form which is capable of being moved (1) into a cooperating position with the jaws of the hand tool to automatically interface a ring fastener from the packaged form contained therein and (2) into a spaced non-interfering position enabling the interfaced ring fastener to be deployed in operative relation with the cable and chain link and then crimped.

In accordance with the principles set forth above, the package of ring fasteners provided includes a multiplicity of similar ring fasteners each being made of a short length of metal wire of no smaller than 0.101 inch diameter material bent to provide a central bight portion and legs extending from opposite ends of the central bight portion terminating in spaced free ends. The multiplicity of ring fasteners are arranged in a packaged orientation wherein the ring fasteners are in a row with the bight portions and legs thereof aligned in the direction of extent of the row. Each ring fastener in the packaged orientation has the bight portion and each leg thereof extending generally transversely to the direction of extent of the row in abutting relation to a bight portion and corresponding leg respectively of an adjacent leading ring fastener in the row except for a leading ring fastener disposed forwardmost in the row. The configuration of each ring fastener in the packaged orientation is such that when present as the leading ring fastener in the row (1) a leading leg of the legs thereof is disposed forwardly in the direction of extent of the row with respect to a trailing leg of the legs thereof so that the free ends of the leading and trailing legs are disposed substantially on opposite sides of a plane perpendicular to the direction of extent of the row and (2) the leading and trailing legs thereof include opposed jaw engaging portions offset in the direction of extent of the row and spaced apart transversely with respect to the direction of extent of the row a distance greater than the spacing between the free ends of the legs. The ring fasteners in the packaged orientation are releasably retained therein in such a way as to enable the ring fasteners in the packaged orientation to be handled and inserted as a unit into a tool magazine capable of being moved transversely from (1) a cooperating position wherein the leading ring fastener of the row interfaces with a pair of tool jaws movable toward and away from one another into (2) a spaced non-interfering position during which the ring fasteners other than the leading ring fastener retained in the packaged orientation are separated from the leading ring fastener in interfaced relation with the pair of jaws enabling the pair of jaws to be moved toward one another so as to move the free ends of the legs of the interfaced leading ring fastener toward one another substantially along opposite sides of the perpendicular plane until the leading ring fastener is crimped into a closed ring configuration wherein free end portions of the legs thereof are disposed generally in side-by-side relation.

In accordance with the principles set forth above, the manually actuated portable tool provided is operable to handle the package of ring fasteners such as previously described and to crimp successive ring fasteners from the package into a closed formation around elements to be retained together such as a fence cable element and a chain link fence link element. Moreover, the portable tool includes a frame providing manually grippable surfaces enabling an operator to manually operate the tool. A pair of jaws is mounted on the frame for movement from a ring fastener interfacing position toward one another through a ring fastener crimping stroke into a crimping position and from the crimping position away from one another through a return stroke into the ring fastener interfacing position. A magazine assembly is provided for receiving and supporting a ring fastener package therein for biased movement forwardly in the direction of extent of the ring fastener row thereof. The magazine assembly is elongated in a longitudinal direction corresponding with the direction of extent of the ring fastener row of the package received and supported therein and is mounted on the frame for movement in a direction transverse to the longitudinal direction between a cooperating position with respect to the pair of jaws and a non-interfering position with respect to the pair of jaws. The pair of jaws have leading and trailing leg engaging surfaces for interfacing with the leading and trailing legs of the leading ring fastener of the ring fastener package. The leading and trailing leg engaging surfaces include (1) longitudinally offset leading and trailing stop surface portions facing in a longitudinal direction toward the magazine assembly when in the cooperating position thereof for engaging forward surface portions of the leading ring fastener so as to position the leading ring fastener in interfaced relation with the pair of jaws and (2) longitudinally offset leading and trailing crimping surface portions facing generally transversely toward one another for engaging the jaw engaging portions of the leading and trailing legs of the leading ring fastener during the crimping stroke of the pair of jaws to thereby crimp the leading ring fastener into the closed ring formation. The frame includes (1) a planar surface transverse to the longitudinal extent of the magazine assembly for engaging the leading ring fastener of the package when the magazine assembly is in the non-interfering position thereof, and (2) a transitional cam surface between the planar surface and the leading crimping surface portion for (A) engaging the leading leg of the leading ring fastener during the last portion of the movement of the magazine assembly into the cooperating position thereof to guide the leading ring fastener under the forward bias thereof into interfaced relation with the pair of jaws and (B) engaging the leading leg of the ring fastener abutting the leading ring fastener during the initial portion of the movement of the magazine assembly out of the cooperating position thereof to cam the leading leg engaged therewith onto the planar surface against the forward bias thereof.

It is recognized that a portable tool operating in a similar mode of operation has been proposed in the patent literature, as evidenced by U.S. Pat. No. 3,064,263, issued Nov. 20, 1962. However, the portable tool disclosed in the '263 patent is shown and described as operating with ring fasteners (1) which are made from metal wire smaller than 12 gauge material, (2) which are configured different from the present ring fasteners, and (3) which provide insufficient strength under the aforesaid fencing specifications to be used to secure a fence cable element with a chain link fence link element. The ring fasteners of the '263 patent are more nearly like conventional staples in that the free ends of the legs are perpendicularly aligned in the row. They differ from conventional staples in that the free ends of the legs are angularly sharpened so that, when they interengage in the same perpendicular plane during the crimping stroke, the legs will cam one another into planes which are different than the perpendicular plane. The portable tool disclosed in the '263 patent likewise has ring fastener interfacing surfaces on the pair of jaws which are aligned longitudinally in the same perpendicular plane to effect the leg camming crimping action. Applicant has found that a ring fastener having the construction shown in the '263 patent with sufficient strength to satisfy the aforesaid fencing specifications made from either 12 gauge steel alloy wire material or 9 gauge aluminum alloy material, cannot be satisfactorily crimped into a closed loop formation by a plier-like tool having the construction shown in '263 and, consequently, the '263 patent does not deal with the specific problem solved by the present invention and, therefore, does not teach a solution thereto.

Another object of the present invention is the provision of a package of ring fasteners which is simple in construction, economical to manufacture, and effective in operation and a portable tool operable to handle a package of such ring fasteners and to crimp successive ring fasteners from the package into a closed formation which is simple in construction, economical to manufacture, and effective in operation.

These and other objects of the present invention will become more apparent during the course of the following detailed description and appended claims.

The invention may best be understood with reference to the accompanying drawings wherein an illustrative embodiment is shown.

IN THE DRAWINGS:

FIG. 10 is a view similar to FIG. 7 showing the pair of jaws in their clinched position and the leading ring fastener crimped into a closed formation securing together a fence cable element and a chain link fence link element;

FIG. 11 is a fragmentary right end view similar to FIG. 10;

FIG. 12 is a fragmentary elevational view taken along the line 12—12 of FIG. 10;

Figure 1:
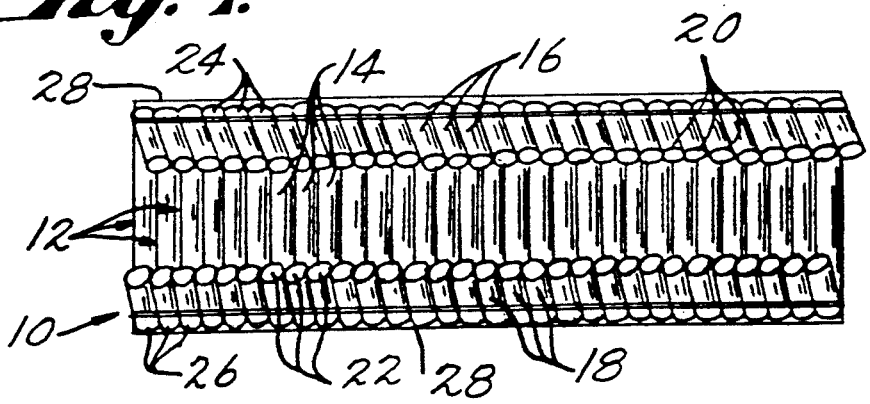
FIG. 1 is a top plan view of a package of ring fasteners embodying the principles of the present invention.
Figure 2:
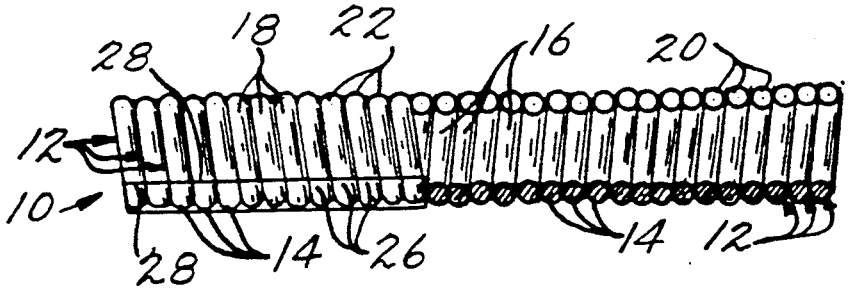
FIG. 2 is a side elevational view of the ring fastener package shown in FIG. 1, partly in section.
Figure 13:
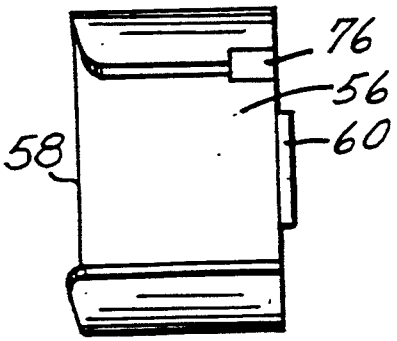
FIG. 13 is a top plan view of the pusher member of the magazine assembly.
Figure 14:
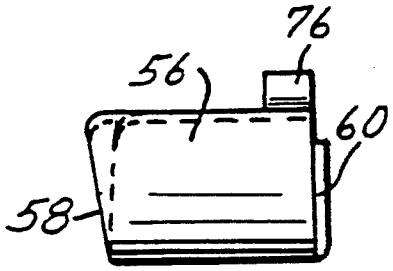
FIG. 14 is a side elevational view of the pusher member shown in FIG. 13.

Referring now more particularly to FIGS. 1 and 2, there is shown therein a package of ring fasteners, generally indicated at 10, which embodies the principles of the present invention. The package 10 includes a multiplicity of similar ring fasteners each of which is generally designated by the reference numeral 12. Each ring fastener is made of a short length of metal wire bent to provide a central bight portion 14 and legs 16 and 18 extending from opposite ends of the central bight portion 14 terminating in spaced free ends 20 and 22. The metal wire is made of material which meets the Federal Highway Specifications—Fencing 909.18, paragraph c, table 1. Included among the materials which can be utilized is a 12 gauge steel alloy material which is of a diameter of 0.106±0.005 inches in diameter. Accordingly, the metal wire material utilized should have a diameter no smaller than 0.101 inches in diameter. A preferred metal wire material which is utilized in accordance with the principles of the present invention is a 9 gauge aluminum alloy material. This material has a diameter of 0.148±0.005 inches.

The multiplicity of ring fasteners 12 which make up the package 10 are arranged in a packaged orientation wherein the ring fasteners 12 are in a row with the bight portions 14 and legs 16 and 18 aligned in the direction of extent of the row. As shown in FIGS. 1 and 2, each ring fastener in the packaged orientation has the bight portion and each leg thereof extending generally transversely to the direction of extent of the row in abutting relation to a bight portion 14 and corresponding leg 16 and 18 respectively of an adjacent leading ring fastener 12 in the row except for a leading ring fastener 12 disposed forwardmost in the row. The configuration of each ring fastener 12 in the packaged orientation is such that, when present as the leading ring fastener in the row, (1) the leading leg 16 is disposed forwardly in the direction of extent of the row with respect to the trailing leg 18 so that the free ends of the leading and trailing legs 16 and 18 are disposed substantially on opposite sides of a plane perpendicular to the direction of extent of the row. The leading and trailing legs 16 and 18 including opposed jaw engaging portions 24 and 26 respectively offset in the direction of extent of the row and spaced apart transversely with respect to the direction of extent of the row a distance greater than the spacing between the free ends 20 and 22. As shown, the opposed jaw engaging portions 24 and 26 are adjacent the junctures of the leading and trailing legs 16 and 18 respectively with the bight portion 14 of each ring fastener 12.

It will also be noted that the length of metal wire forming the bight portion 14 of each ring fastener 12 is greater than the combined length of metal wire forming both the leading leg 16 and the trailing leg 18. The bight portion 14 has a slight curvature therein which facilitates the crimping action of the ring fastener 12. Moreover, the full round cross-sectional configuration of the wire material may be suitable modified as by a slight flattening before being bent into its preformed configuration. In this regard, it will also be noted that the offset of the wire material from the perpendicular plane starting at the leading free end 20 and extending to the trailing free end 22 of each ring fastener 12 is at a substantially constant rate. This configuration therefore results in the perpendicular plane intersecting the entire bight portion 14 of each ring fastener 12 and a substantial part of each of the legs 16 and 18 extending therefrom. The amount of material of the leading leg 16 which is forwardly of the perpendicular plane progressively increases from its juncture with the bight portion 14 in a direction toward the free end 20 thereof. Conversely, the amount of material of the trailing leg 18 rearwardly of the perpendicular plane increases from the juncture with the bight portion 14 in a direction toward the free end 20 thereof. The extent of the material of the bight portion 14 forwardly of the perpendicular plane measured at the juncture with the leading leg 16 is equal to the extent of the bight portion rearwardly of the perpendicular plane measured at the juncture thereof with the trailing leg 18. At the center of the bight portion 14 an equal amount of material extends both forwardly and rearwardly of the perpendicular plane.

The multiplicity of ring fasteners 12 are releasably retained in their packaged orientation by any means heretofore known in effecting such securement of staples in stick formation. However, it should be noted that, whereas staples are releasably separated by an impact driving action, the separation of the leading ring fastener 12 from the remaining ring fasteners 12 of the package 10 of the present invention is accomplished, as will become more apparent hereinafter, by a manual transverse movement of a magazine assembly. Thus, the releasing movement in the case of a staple stick is a movement which is transverse with respect to a flat bight portion of the leading staple whereas the releasing movement of the present package is a movement substantially in the direction of extent of the bight portion of the leading ring fastener 12. Consequently, it is preferable that the releasable securing means not be applied throughout the bight portion. Preferably, the releasable securing means is spaced along the legs and specifically at the juncture thereof with the bight portions. A preferred means for releasably securing the ring fasteners in the packaged orientation is to use two lengths of tape 28 such as, for example, type 109 tape manufactured by the 3M Company, which is a polyester tape having a heat sensitive adhesive applied to one side thereof. Each length of tape 28 is approximately 3 mils. in thickness and approximately 0.25 inches wide. Each length of tape 28 is equal in length to the length of the row and is applied to the exterior juncture between the bight portions 14 and each of the leading and trailing legs 16 and 18. After the tapes 28 have been applied, sufficient heat is then applied to activate the heat sensitive adhesive and effect the adhesion of the tapes to the ring fasteners.

Referring now more particularly to FIGS. 3–12 of the drawings, there is shown therein a manually actuated portable tool, generally indicated at 30, which embodies the principles of the present invention. The portable tool 30 is preferably of the one-handed plier type and includes a frame, generally indicated at 32,, which consists essentially of two frame members 34 and 36 which are pivotally interconnected together, as by a pivot assembly 38. The two frame members provide a pair of handle portions covered by hand grips 40 so as to define a pair of handles having exterior surf aces which are adapted to be gripped by a user in one hand enabling the user to move the handles 40 from a leading ring fastener interfacing position, as shown in FIGS. 3, 4, and 6–9, toward one another through a crimping stroke into a crimping position, as shown in FIGS. 10–12. A spring assembly 42 is provided between the frame members 34 and 36 to effect a movement of the handles in a direction away from each other through a return stroke from the crimped position into the leading ring fastener interfacing position.

Figure 3:
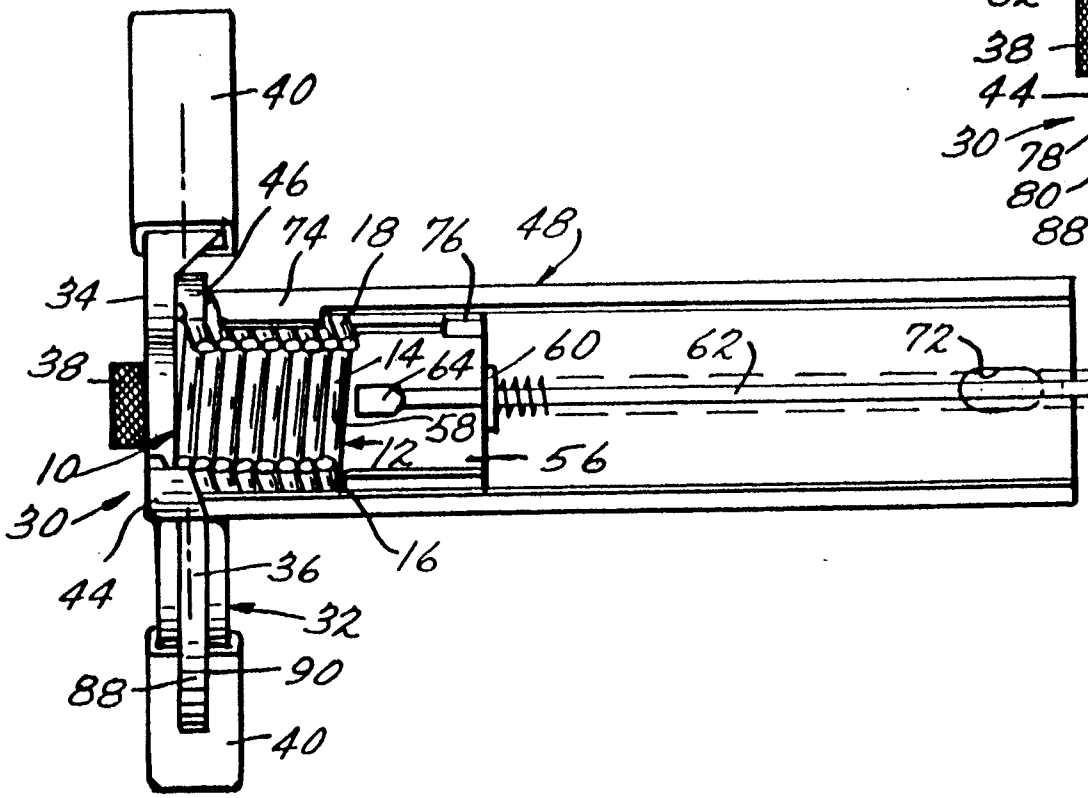
FIG. 3 is a top plan view of a portable tool embodying the principles of the present invention which is operable with the ring fastener package shown in FIGS. 1 and 2, the magazine assembly of the portable tool being shown in its cooperating position with respect to the pair of jaws of the tool.
Figures 4, 5:
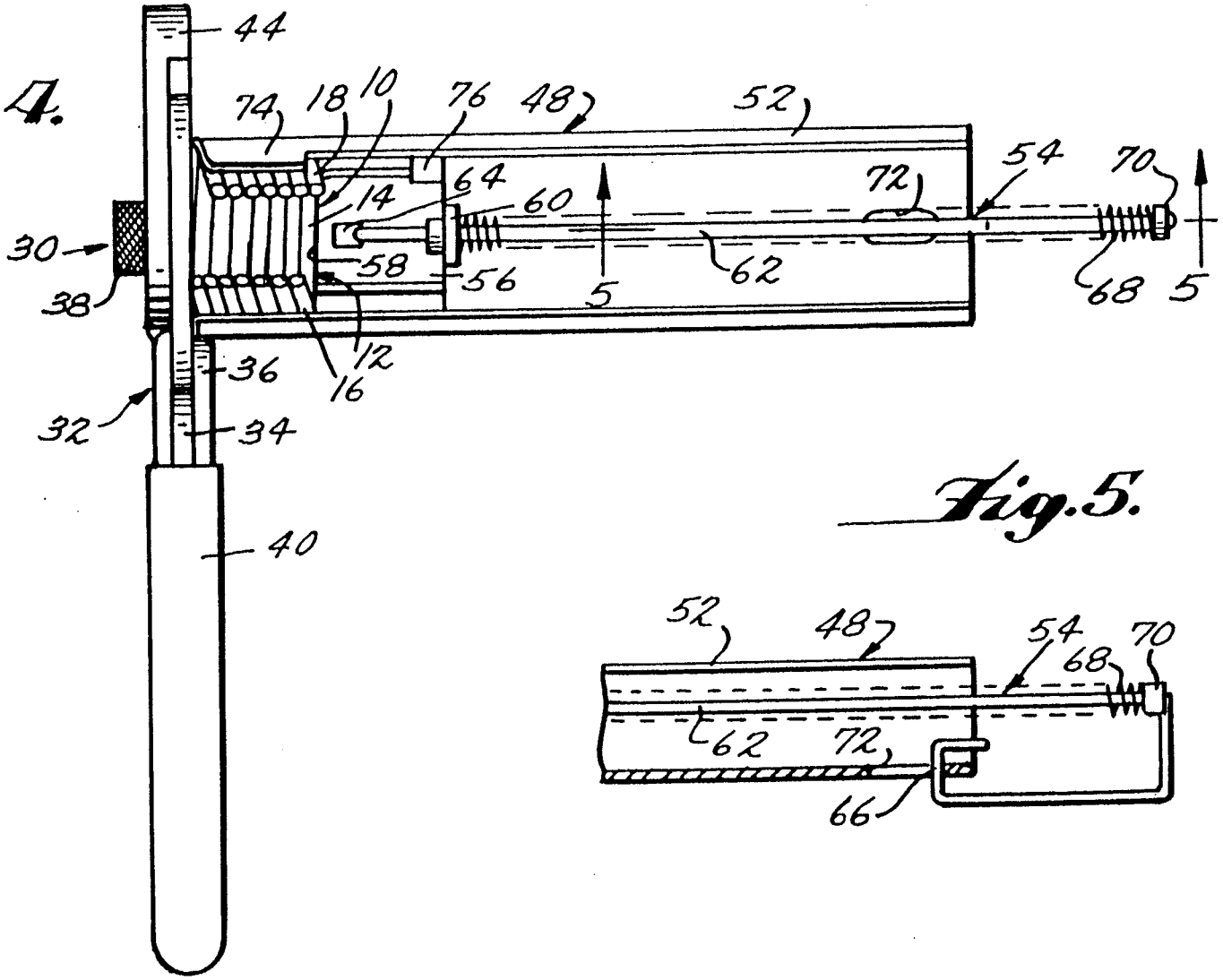
FIG. 4 is a side elevational view of the tool shown in FIG. 3 with the magazine assembly shown in its non-interfering position with respect to the jaws of the tool.
FIG. 5 is a fragmentary sectional view taken along the line 5—5 of FIG. 4.
Figure 6:
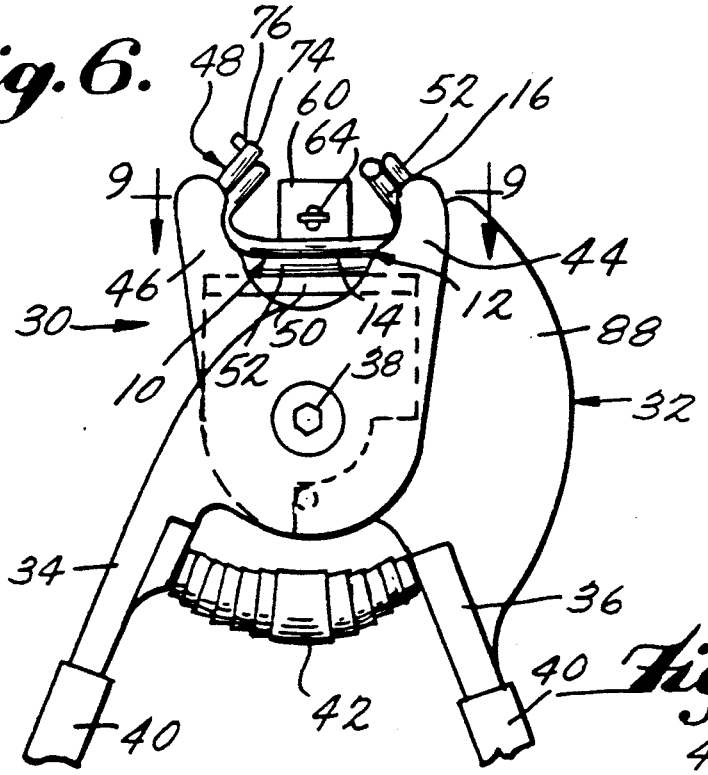
FIG. 6 is a fragmentary left end view of the tool as shown in FIG. 3.

The tool 30 also includes a pair of jaws 44 and 46, formed as an integral part of the frame members 34 and 36, respectively, and a magazine assembly, generally indicated at 48, mounted on the frame 32 for transverse movement between a cooperating position with respect to the pair of jaws 44 and 46, as shown in FIGS. 3, 4, and 6, and a non-interfering position with respect to the pair of jaws 44 and 46, as shown in FIGS. 7–12.

The magazine assembly 48 is preferably mounted on the frame 32 for pivotal movement by an L-shaped bracket 50 one leg of which receives the pivot assembly 38 therethrough so as to make the axis of pivotal transverse movement of the magazine assembly 48 about an axis which is coincident with the axis of pivotal movement of the handles 40. The opposite leg of the L-shaped bracket 50 is fixed to the underside of a guide structure 52 which has a cross-sectional shape sufficient to receive and support therein a package 10 so that the package can slide within the guide structure 52 in the direction of extent of the row. The longitudinal guide structure 52 is generally aligned longitudinally with the pair of jaws 44 and 46 when the magazine assembly 48 is in its cooperating position, as shown in FIGS. 3, 4 and 6. The outer end of the guide structure 52 is open so as to receive the leading end of a package 10 therein for forward sliding movement in a direction toward the jaws 44 and 46 so that the leading ring fastener 12 of the package 10 is presented forwardly along the extent of the row in interfaced relation between the jaws 44 and 46 when in their interfacing position, as shown in FIGS. 3, 4 and 6–9.

The magazine assembly 48 includes a pusher assembly, generally indicated at 54, which serves to resiliently bias the package 10 of ring fasteners 12 in a forward direction so that the leading ring fastener 12 is interfaced with the pair of jaws 44 and 46 when the magazine assembly 48 is in its cooperating position. The pusher assembly 54 includes a pusher member 56 which is formed of sheet metal so as to have a cross-sectional configuration generally the same as the configuration of the ring fasteners 12. The pusher member 56 includes a ring fastener engaging forward edge 58 which is shaped to engage the trailing ring fastener 12 of the package 10 mounted in the guide structure 52. The pusher member 56 includes an upstanding tab 60 which is apertured to receive an elongated rod 62 which extends therethrough. As best shown in FIGS. 3 and 5, the forward end of the rod 62 is deformed, as indicated at 64, to capture the rod within the tab 60 and the rearward end portion is bent into a forwardly extending rearwardly facing hook configuration 66 which is disposed below the longitudinal extent of the row. As best shown in FIG. 5, the rearward end portion of the rod 62 is bent first downwardly and then forwardly then upwardly and finally rearwardly to form the hook 66.

The pusher assembly 54 also includes a compression coil spring 68 which is mounted in surrounding relation to the rod 62 at a position rearwardly of the tab 60 and forwardly of the bent rearward end portion thereof. As shown, the forward end of the coil spring 68 engages the tab 60 while the rearward end engages a washer 70 engaging the bent rear end portion of the rod 62. In this way, the coil spring 68 serves to resiliently bias the pusher member 56 forwardly along the rod 62 but allows the pusher member 56 to move rearwardly against the bias of the spring.

The hook configuration 66 of the rod 62 is adapted to enter within an opening 72 formed in the rearward central portion of the guide structure 52. The rearwardly facing hook 66 can be manually engaged upwardly through the opening 72 and then released to be biased rearwardly into the operative position shown in FIG. 5 by the spring 68.

When it is desired to insert a new package 10 in the guide structure 52, the rod 62 of the pusher assembly 54 is moved forwardly and then downwardly to pass the hook 66 through the opening 72 thus enabling the pusher -member 56 to be removed from the guide structure 52 rearwardly. A package 10 can then be inserted forwardly through the open rearward end of the guide structure 52 into a forwardmost position. Thereafter, the pusher member 56 is entered into the open rear end of the guide structure 52 and the rod 62 is moved forwardly compressing the spring 68 and enabling the rearwardly facing hook 66 to be engaged through the opening 72 into the operative position as shown in FIG. 5. It will be understood that the spring 68 biases the pusher member 56 forwardly so that the entire package 10 is biased forwardly thereby ensuring that the leading ring fastener 12 will interface with the pair of jaws 44 and 46. In this regard, it will be noted that the forward end of the guide structure 52 includes an upwardly extending stop portion 74 which is adapted to cooperate with a stop tab 76 formed on the pusher member 56 when the package 10 is depleted so as to prevent the forward edge of the pusher member 56 from interfacing with the jaws 44 and 46.

Figure 9:
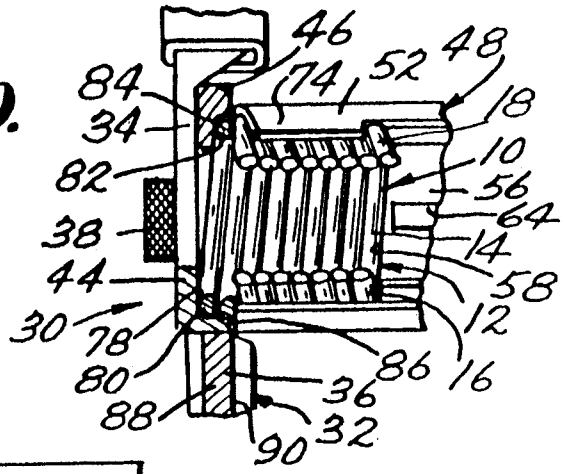
FIG. 9 is a fragmentary sectional view taken along the line 9—9 of FIG. 6.
Figure 8:
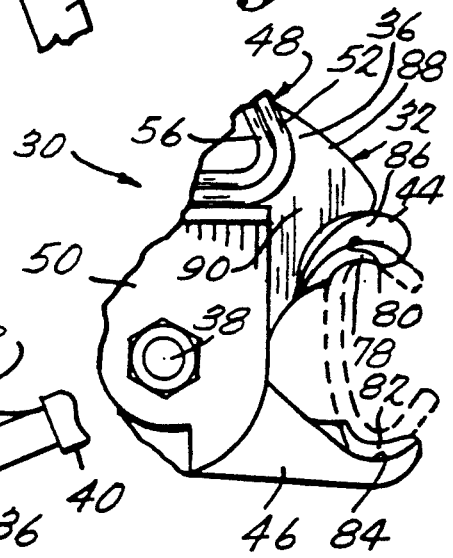
FIG. 8 is a fragmentary right end view of the tool shown in FIG. 7 with the leading ring fastener shown in dotted lines.
Figure 7:
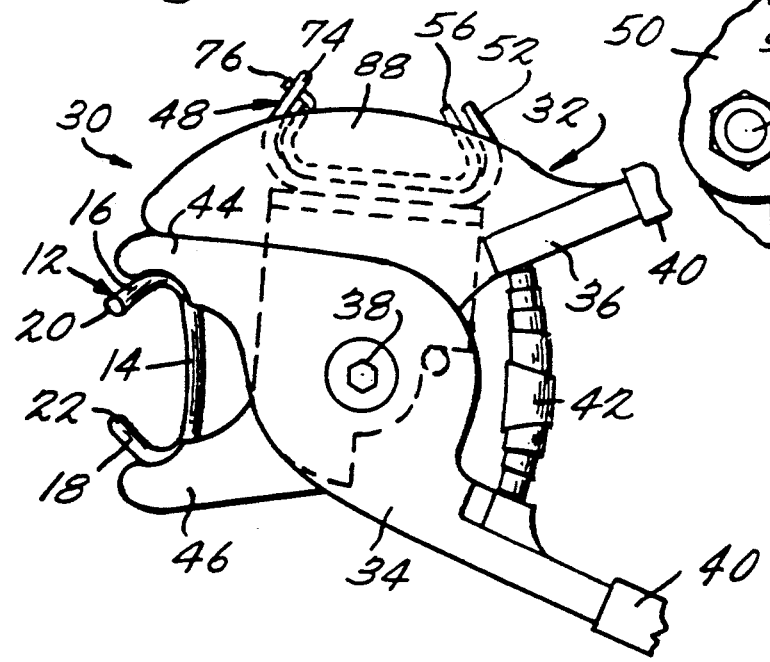
FIG. 7 is a fragmentary left end view of the tool as shown in FIG. 4.

As best shown in FIGS. 6–8, the jaw 44 constitutes a leading jaw 44 which is positioned to cooperate with the leading leg 16 of the leading ring fastener 12 and the jaw 46 constitutes a trailing jaw 46 which is adapted to cooperate with the trailing leg 18 of the leading ring fastener 12 when the leading ring fastener is interfaced with the jaws 44 and 46. As shown, the leading and trailing jaws 44 and 46 are formed with leading and trailing leg engaging surfaces. The leading leg engaging surfaces of the leading jaw include a leading stop surface portion 78 of arcuate configuration so as to be engaged by the forward surface of the leading leg 16 of the leading ring fastener 12 at a position spaced from the free end 20 thereof. The leading leg engaging surface also includes a leading crimping surface portion 80 which extends generally at right angles with respect to the stop surface portion 78 and has a smooth transition with respect thereto. The trailing leg engaging surfaces on the trailing jaw 46 also include a rearwardly facing stopping surface portion 82 which is shaped to engage the forward surface of the trailing leg 18 of the leading ring fastener 12 and a trailing crimping surface portion 84 which extends at right angles to the stop surface portion 82 and has a smooth transition with respect thereto. As best shown in FIG. 9, the leading and trailing stop surface portions 78 and 82 face rearwardly and are longitudinally offset with respect to the extent of the row of the package 10. The leading and trailing crimping surface portions 80 and 84 are also longitudinally offset and face generally in a transverse direction toward one another so as to be in positions to engage the jaw engaging surfaces 24 and 26 respectively of the ring fastener 12.

As best shown in FIG. 9, an inclined cam surface 86 extends rearwardly and outwardly from the leading crimping surface portion 80. As best shown in FIGS. 6–9, the frame member 36 which has the trailing jaw 46 integral therewith also includes an enlarged frame portion 88 which provides a rearwardly facing planar surface 90 aligned generally with the rearward surface of the trailing jaw 46. As shown in FIGS. 3, 4, 6, and 9, when the magazine assembly 48 is disposed in its cooperating position with respect to the jaws 44 and 46 and the latter are in their interfacing position, the leading ring fastener 12 will be biased forwardly by the spring 68 of the pusher assembly 54 so as to move into interfaced relation with the stop surface portions 78 and 82 of the leading and trailing jaws 44 and 46. In this position, the planar surface 90 is disposed so as to align with the rearward end of the cam surface 86. It can be seen from FIGS. 3, 4, and 6 that the operator of the tool 30 can conveniently grasp the handles 40 with his right hand with a grip which will enable the handles 40 to be squeezed together until the jaw engaging portions 24 and 26 of the leading ring fastener 12 are engaged by the crimping surface portions 80 and 84. By grasping the exterior surface of the guide structure 52 with the left hand, the guide structure 52 of the magazine assembly 48 can be manually moved from its cooperating position with respect to the jaws 44 and 46 into its non-interfering position as shown in FIGS. 7–12.

It will be noted that, during the movement of the magazine guide structure 52 from its cooperating position toward its non-interfering position, the ring fastener 12 next to the leading ring fastener is moved with the magazine guide structure 52 transversely with respect to the leading ring fastener which is interfaced and grasped within the two jaws 44 and 46. This movement therefore serves to accomplish the fracture of the length of tapes 28 which are releasably retaining the leading ring fastener 12 with the other ring fasteners in the package 10.

Preferably, the movement of the guide structure 52 of the magazine assembly 48 is limited to movement between the cooperating and the non-interfering positions thereof by any suitable means, such as a pin 92 extending rearwardly from the frame member 34 into a 90° sector 94 removed from the L-shaped mounting bracket 50, as shown in FIG. 11.

It will also be noted that, during the movement of the magazine guide structure 52 from its cooperating position into its non-interfering position, the leading leg 16 of the ring fastener 12 next to the leading ring fastener interfaced with the jaws 44 and 46 will be moved with the guide structure 52 into engagement with the cam surface 86 which causes the ring fastener 12 to be moved rearwardly against the bias of spring 68. As soon as the leading leg 16 of the ring fastener 12 moves off of the cam surface 86, it is guided onto the planar surface 90 so that the remainder of the ring fasteners are retained within the guide structure 52. In this regard, it will be noted that the forward trailing edge of the guide structure 52 which is adjacent the trailing leg 18 of the ring fastener 12 is spaced from a plane coincident with the planar surface 90 which is less than the dimension of the trailing leg 18 measured in the direction of extent of the row.

It will be understood that, when the magazine guide structure 52 is in its non-interfering position, it is resiliently retained therein by virtue of the engagement of the now leading ring fastener 12 with the planar surface 90 under the resilient bias of the spring 68. Moreover, it will be noted that, in the non-interfering position of the magazine guide structure 52, the jaws 44 and 46 with the previous leading ring fastener interfaced and grasped therein is unobstructed and can be moved in cooperating relation with the two elements to be interconnected, as for example, a cable element and a link element of a chain link fence. As shown, the leading ring fastener in interfaced relation with the jaws can be retained therein by a slight pressure on the handles 40 which serve to grip the crimping surface portions 80 and 84 with the jaw-engaging surfaces 24 and 26 respectively of the ring fastener 12. As soon as the two elements are disposed between the leading and trailing legs 16 and 18 of the ring fastener 12, the operator can then by a squeezing action move the jaws 44 and 46 through their crimping stroke which has the effect of bending the bight portion 14 at its center and moving the free ends 20 and 22 of the leading and trailing legs 16 and 18 past one another until the ring fastener 12 is in a closed ring formation about the two elements. It will be noted from FIGS. 10 and 11 that, when the ring fastener 12 is in its closed formation, the ring fastener is in a delta or equilateral triangular configuration, two legs of which are formed by the bent bight portion 14 and the third leg of which is formed by the leading and trailing legs 16 and 18 disposed in substantially side-by-side abutting relation.

After the leading ring fastener 12 has been thus crimped into its closed formation about the elements,, the operator releases the grip on the handles 40 enabling the spring assembly 42 to return the jaws 44 and 46 to their ring fastener interfacing position. Thereafter, the operator grasps the exterior surface of the guide structure 52 in his left hand and, while holding the handles 40 in the right hand, moves the magazine guide structure 52 from its non-interfering position into its cooperating position. As soon as the leading leg 16 of the now leading ring fastener 12 in the magazine guide structure 52 passes from the planar surface 90 onto the cam surface 86, the leading ring fastener 12 is then biased by the spring 68 to move into engagement with the stop surface portions 78 and 82 in interfaced relation with the two jaws 44 and 46 as the magazine guide structure 52 is finally moved into its cooperating position.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. A package of ring fasteners comprising a multiplicity of similar ring fasteners each being made of a short length of metal wire of no smaller than 0.101 inch diameter material bent to provide a central bight portion and legs extending from opposite ends of said central bight portion terminating in spaced free ends, said multiplicity of ring fasteners being arranged in a packaged orientation wherein the ring fasteners are in a row with the bight portions and legs thereof aligned in the direction of extent of the row, each ring fastener in said packaged orientation having the bight portion and each leg thereof extending generally transversely to the direction of extent of the row in abutting relation to a bight portion and corresponding leg respectively of an adjacent leading ring fastener in the row except for a leading ring fastener disposed forwardmost in the row, the configuration of each ring fastener in said packaged orientation being such that when present as the leading ring fastener in the row (1) a leading leg of the legs thereof is disposed forwardly in the direction of extent of the row with respect to a trailing leg of the legs thereof so that the free ends of the leading and trailing legs are disposed substantially on opposite sides of a plane perpendicular to the direction of extent of the row and (2) the leading and trailing legs thereof include opposed jaw engaging portions offset in the direction of extent of the row and spaced apart transversely with respect to the direction of extent of the row a distance greater than the spacing between the free ends of said legs, and means for releasably retaining said ring fasteners in said packaged orientation enabling the ring fasteners in said packaged orientation to be handled and inserted as a unit into a tool magazine capable of being moved transversely from (1) a cooperating position wherein the leading ring fastener of the row interfaces with a pair of tool jaws movable toward and away from one another into (2) a spaced non-interfering position during which the ring fasteners other than said leading ring fastener retained in said packaged orientation are separated from the leading ring fastener in interfaced relation with the pair of jaws enabling the pair of jaws to be moved toward one another so as to move the free ends of the legs of the interfaced leading ring fastener toward one another substantially along opposite sides of said perpendicular plane until the leading ring fastener is crimped into a closed ring configuration wherein free end portions of the legs thereof are disposed generally in side-by-side relation, the length of metal wire forming the bight portion being greater than the combined length of metal wire forming the legs, said bight portion being bent at its center into an angular configuration during the crimping movement so that the resultant closed ring formation is generally an equilateral triangular configuration two sides of which are formed by the angularly bent bight portion and the third side of which is formed by the legs with their free end portions in side-by-side relation, each of said ring fasteners being configured so that the aforesaid perpendicular plane intersects the entire bight portion thereof and a substantial part of each leg extending therefrom, the amount of material of said leading leg forwardly of the perpendicular plane progressively increasing in a direction toward the free end thereof and the amount of material of the trailing leg rearwardly of the perpendicular plane increasing in a direction toward the free end thereof.

2. A package as defined in claim 1 wherein the metal wire is a 12 gauge steel alloy.

3. A package as defined in claim 1 wherein the metal wire is a 9 gauge aluminum alloy.

4. A package as defined in claim 1 wherein the extent of material of the bight portion forwardly of the perpendicular plane measured at the juncture with said leading leg being equal to the extent of material of the bight portion rearwardly of the perpendicular plane measured at the juncture thereof with said trailing leg.

5. A package as defined in claim 4 wherein the extent of the material of the bight portion forwardly of the perpendicular plane measured at the center of the bight portion being equal to the extent of the material of the bight portion rearwardly of the perpendicular plane measure at the center of the bight portion.

6. A package as claimed in claim 5 wherein said releasable retaining means comprises a first length of polyester tape approximately ¼ inches wide fixed by a heat sensitive adhesive to the exterior juncture between the bight portions of the ring fasteners in the row and the leading legs of ring fasteners in the row and a second length of polyester tape approximately ¼ inches wide fixed by a heat sensitive adhesive to the exterior juncture between the bight portions of the ring fasteners of the row and the trailing legs of the ring fasteners of the row.

7. A package as defined in claim 1 wherein the length of metal wire forming the bight portion is greater than the combined length of metal wire forming the legs, said bight portion being bent at its center into an angular configuration during the crimping movement so that the resultant closed ring formation is generally an equilateral triangular configuration two sides of which are formed by the angularly bent bight portion and the third side of which is formed by the legs with their free end portions in side-by-side relation.

8. A package of ring fasteners comprising a multiplicity of similar ring fasteners each being made of a short length of metal wire of no smaller than 0.101 inch diameter material bent to provide a central bight portion and legs extending from opposite ends of said central bight portion terminating in spaced free ends, said multiplicity of ring fasteners being arranged in a packaged orientation wherein the ring fasteners are in a row with the bight portions and legs thereof aligned in the direction of extent of the row, each ring fastener in said packaged orientation having the bight portion and each leg thereof extending generally transversely to the direction of extent of the row in abutting relation to a bight portion and corresponding leg respectively of an adjacent leading ring fastener in the row except for a leading ring fastener disposed forwardmost in the row, the configuration of each ring fastener in said packaged orientation being such that when present as the leading ring fastener in the row (1) a leading leg of the legs thereof is disposed forwardly in the direction of extent of the row with respect to a trailing leg of the legs thereof so that the free ends of the leading and trailing legs are disposed substantially on opposite sides of a plane perpendicular to the direction of extent of the row and (2) the leading and trailing legs thereof include opposed jaw engaging portions offset in the direction of extent of the row and spaced apart transversely with respect to the direction of extent of the row a distance greater than the spacing between the free ends of said legs, and means for releasably retaining said ring fasteners in said packaged orientation enabling the ring fasteners in said packaged orientation to be handled and inserted as a unit into a tool magazine capable of being moved transversely from (1) a cooperating position wherein the leading ring fastener of the row interfaces with a pair of tool jaws movable toward and away from one another into (2) a spaced non-interfering position during which the ring fasteners other than said leading ring fastener retained in said packaged orientation are separated from the leading ring fastener in interfaced relation with the pair of jaws enabling the pair of jaws to be moved toward one another so as to move the free ends of the legs of the interfaced leading ring fastener toward one another substantially along opposite sides of said perpendicular plane until the leading ring fastener is crimped into a closed ring configuration wherein free end portions of the legs thereof are disposed generally in side-by-side relation, each of said ring fasteners being configured so that the aforesaid perpendicular plane intersects the entire bight portion thereof and a substantial part of each leg extending therefrom, the amount of material of said leading leg forwardly of the perpendicular plane progressively increasing in a direction toward the free end thereof and the amount of material of the trailing leg rearwardly of the perpendicular plane increasing in a direction toward the free end thereof.

9. A package as claimed in claim 1 wherein said releasable retaining means comprises a first length of polyester tape approximately ¼ inches wide fixed by a heat sensitive adhesive to the exterior juncture between the bight portions of the ring fasteners in the row and the leading legs of ring fasteners in the row and a second length of polyester tape approximately ¼ inches wide fixed by a heat sensitive adhesive to the exterior juncture between the bight portions of the ring fasteners of the row and the trailing legs of the ring fasteners of the row.

10. A manually actuated portable tool operable to handle a package of ring fasteners and to crimp successive ring fasteners from the package into a closed formation around elements to be retained together, such as a fence cable element and a chain link fence link element, said package of ring fasteners comprising a multiplicity of similar ring fasteners each being made of a short length of metal wire of no smaller than 0.101 inch diameter material bent to provide a central bight portion and legs extending from opposite ends of the central bight portion terminating in spaced free ends, the multiplicity of ring fasteners being arranged in a packaged orientation wherein the ring fasteners are in a row with the bight portions and legs thereof aligned in the direction of extent of the row, each ring fastener in the packaged orientation having the bight portion and each leg thereof extending generally transversely to the direction of extent of the row in abutting relation to a bight portion and corresponding leg respectively of an adjacent leading ring fastener in the row except for a leading ring fastener disposed forwardmost in the row, the configuration of each ring fastener in the packaged orientation being such that when present as the leading ring fastener in the row (1) a leading leg of the legs thereof is disposed forwardly in the direction of extent of the row with respect to a trailing leg of the legs thereof so that the free ends of the leading and trailing legs are disposed substantially on opposite sides of a plane perpendicular to the direction of extent of the row and (2) the leading and trailing legs thereof include opposed jaw engaging portions offset in the direction of extent of the row and spaced apart transversely with respect to the direction of extent of the row a distance greater than the spacing between the free ends of said legs, said portable tool comprising a frame providing manually grippable surfaces enabling an operator to manually operate the tool, a pair of jaws mounted on said frame for movement from a ring fastener interfacing position toward one another through a ring fastener crimping stroke into a crimping position and from said crimping position away from one another through a return stroke into said ring fastener interfacing position, a magazine assembly for receiving and supporting a ring fastener package therein for biased movement forwardly in the direction of extent of the ring fastener row thereof, said magazine assembly being elongated in a longitudinal direction corresponding with the direction of extent of the ring fastener row of the package received and supported therein and being mounted on said frame for movement in a direction transverse to said longitudinal direction between a cooperating position with respect to said pair of jaws and a non-interfering position with respect to said pair of jaws, said pair of jaws having leading and trailing leg engaging surfaces for interfacing with the leading and trailing legs of the leading ring fastener of the ring fastener package, said leading and trailing leg engaging surfaces including (1) longitudinally offset leading and trailing stop surface portions facing in a longitudinal direction toward said magazine assembly when in said cooperating position for engaging forward surface portions of the leading ring fastener so as to position the leading ring fastener in interfaced relation with said pair of jaws and (2) longitudinally offset leading and trailing crimping surface portions facing generally transversely toward one another for engaging the jaw engaging portions of the leading and trailing legs of the leading ring fastener during the crimping stroke of the pair of jaws to thereby crimp the leading ring fastener into the closed ring formation, said frame including (1) a planar surface transverse to the longitudinal extent of said magazine assembly for engaging the leading ring fastener of the package when said magazine assembly is in said non-interfering position, and (2) a transitional cam surface between said planar surface and said leading crimping surface portion for (A) engaging the leading leg of the leading ring fastener during the last portion of the movement of the magazine assembly into said cooperating position to guide the leading ring fastener under the forward bias thereof into interfaced relation with said pair of jaws and (B) engaging the leading leg of the ring fastener abutting the leading ring fastener during the initial portion of the movement of the magazine assembly out of said cooperating position to cam the leading leg engaged therewith onto said planar surface against the forward bias thereof.

11. A portable tool as defined in claim 10 wherein said magazine assembly includes guide structure for guidingly engaging the ring fasteners of the package except for the leading ring fastener during the movement of said magazine assembly from said cooperating position into said non-interfering position, said guide structure having a leading edge movable through a transverse plane spaced rearwardly from said planar surface a distance less than the dimension of the trailing leg of a ring fastener measured in the direction of extent of the ring fastener row.

12. A portable tool as defined in claim 11 wherein said guide structure comprises an elongated wall of inverted U-shaped cross-sectional configuration conforming generally to the exterior shape of said package of ring fasteners.

13. A portable tool as defined in claim 12, wherein said U-shaped wall is open at its rearward end and said magazine assembly includes a pusher member movable forwardly within the open end of said U-shaped wall into longitudinal sliding relation therein, a rod-like element connected with said pusher member so as to be movable therewith within the open end of said U-shaped wall into a detachably fixed operative position extending longitudinally within the U-shaped wall throughout a substantial longitudinal extent thereof,, and a compression spring surrounding said rod-like element having a rearward end fixed with respect to said rod-like element and a forward end acting on said pusher member so as to resiliently bias said pusher member forwardly for sliding movement within said U-shaped wall with respect to said rod-like element in abutting engagement with the trailing ring fastener of the package to thereby provide the forward bias on the package.

14. A portable tool as defined in claim 13 wherein said frame includes a pair of handles pivotally mounted with respect to one another and fixed respectively with the pair of jaws, said handles providing said manually engageable surfaces so as to enable a one hand manual squeezing action on said handles to effect movement of said jaws from said interfacing position to said crimping position and spring means acting between said handles for effecting movement of said jaws from said clinching position into said interfacing position when the aforesaid manual squeezing action is released.

15. A portable tool as defined in claim 14 wherein said U-shaped wall includes an exterior periphery shaped to be manually gripped to effect manual movement of said magazine assembly between the cooperating and non-interfering positions thereof.

16. A portable tool as defined in claim 15 wherein said magazine assembly is mounted for pivotal movement about the same axis as the pivotal mounting of said pair of handles.

17. A portable tool as defined in claim 10 wherein said frame includes a pair of handles pivotally mounted with respect to one another and fixed respectively with the pair of jaws, said handles providing said manually engageable surfaces so as to enable a one hand manual squeezing action on said handles to effect movement of said jaws from said interfacing position to said crimping position and spring means acting between said handles for effecting movement of said jaws from said clinching position into said interfacing position when the aforesaid manual squeezing action is released.

18. A portable tool as defined in claim 17 wherein said magazine assembly is mounted for pivotal movement about the same axis as the pivotal mounting of said pair of handles.

* * * * *